US005414977A

United States Patent [19]

Cohen

[11] Patent Number: 5,414,977

[45] Date of Patent: May 16, 1995

[54] ENVELOPE STUFFING DEVICE

[75] Inventor: Jack Cohen, Norwalk, Conn.

[73] Assignee: Pitney Bowes Inc., Stamford, Conn.

[21] Appl. No.: 97,091

[22] Filed: Jul. 12, 1993

Related U.S. Application Data

[63] Continuation of Ser. No. 860,336, Mar. 30, 1992, abandoned.

[51] Int. Cl.[6] ..... B65B 43/26

[52] U.S. Cl. ..... 53/460; 53/569; 53/381.5

[58] Field of Search ..... 53/262, 284.3, 381.5, 53/381.6, 381.7, 460, 569

[56] References Cited

U.S. PATENT DOCUMENTS

| | | | |
|---|---|---|---|
| 2,839,880 | 6/1958 | Boughton . | |
| 3,884,010 | 5/1975 | Bardo et al. | 53/381.6 X |
| 3,886,715 | 6/1975 | Dorer . | |
| 3,910,007 | 10/1975 | Dorer | 53/569 X |
| 4,020,615 | 5/1977 | Irvine et al. | 53/284.3 X |
| 4,079,576 | 3/1978 | Morrison et al. . | |
| 4,205,506 | 6/1980 | Moens et al. | 53/284.3 X |
| 4,337,609 | 7/1982 | Foster et al. . | |
| 4,471,598 | 9/1984 | Sanz | 53/284.3 |
| 4,674,258 | 6/1987 | Ehlscheid et al. | 53/569 X |
| 4,813,209 | 3/1989 | Foster et al. | 53/284.3 X |
| 4,817,369 | 4/1989 | Tribbey | 53/284.3 X |
| 4,924,652 | 5/1990 | Krasuski et al. . | |

*Primary Examiner*—Linda B. Johnson

*Attorney, Agent, or Firm*—Ronald Reichman; Melvin J. Scolnick

[57] ABSTRACT

An envelope stuffing device in which no moving parts are required for opening the mouth of an envelope for the insertion of inserts therein. The stuffing device has a plurality of leaf springs, two of which are adjacent the ends of an envelope and are located directly above openings within a floor of the device. Other leaf springs are located intermediate the ends of an envelope, so that when the flap of the envelope is in registration with the leaf springs, the outer leaf springs push down on the end of the envelope and the intermediate leaf springs hold the flap on the floor, thereby causing the mouth of the envelope to open. The device includes a conveying mechanism for placing inserts into to envelope when the mouth of the envelope is open.

16 Claims, 3 Drawing Sheets

ENVELOPE STUFFING DEVICE

This application is a continuation of application Ser. No. 07/860,336, filed Mar. 30, 1992, now abandoned.

BACKGROUND OF THE INVENTION

In mail production equipment, various activities take place for the purpose of producing mail pieces. Such activities include the selection of inserts, the collection and stacking of the selected inserts, the placing of the inserts into an envelope and the sealing of the envelope to form the mail piece. In order for the inserts to be stuffed into an envelope, the mouth of the envelope must be opened so as to be able to receive the inserts.

Devices that have been used previously, as a general rule, tend to have a relatively large number of moving parts for the stuffing operation. One of the more widely used ways of stuffing inserts into envelopes is to use a fingers that first open the mouth of an envelope that is being held stationary, and then assisting in the placing of inserts into the envelope. After insertion is complete, the fingers are removed from the mouth of the envelope and the stuffed envelope is carried away in an appropriate manner.

Although such devices worked well with production equipment that was of a large size, with the increasing demand for miniaturization and modular equipment, it has become evident that an envelope stuffing device that takes less space and has no moving parts for opening the mouth of an envelope would be desirable. Clearly, if moving parts are required to open the mouth of an envelope, a mechanism that would perform such a task requires space and results in a more expensive device.

SUMMARY OF THE INVENTION

A envelope stuffing device has been conceived wherein no moving parts are required for the purpose of opening the mouth of the envelope. A longitudinal housing is provided for conveying an envelope with the flap of the envelope being in the trailing position. Mechanisms are provided for conveying inserts into contact with the envelope. The floor of the housing has a pair of laterally spaced openings, each of which straddles the lateral side of the floor. A plurality of leaf springs is provided that are laterally aligned and space from one another. The two outer leaf springs are located above the floor openings so as to depress the outer edges of the envelope. The other springs are located so as to depress the portions of the envelope located intermediate the openings. When the envelope is conveyed a sufficient distance, the leaf springs will engage the flap. With this arrangement, the outer most leaf springs push down on the outer portions of the flap, while the inner leaf springs firmly hold the center of the envelope flap to the floor of the housing. This causes the envelope to "pucker", i.e. the mouth of the envelope to open. At this point, the envelope is held stationary, and with the mouth of the envelope open, inserts are placed into the envelope by the conveying mechanisms. During this period, the device acts as an insert accumulator so that a number of inserts can be placed into a single envelope. After the stuffing of the inserts into the envelope is complete, the stuffed envelope is carried away.

DETAILED DESCRIPTION OF THE PREFERRED EMBODIMENT

Figure 1:
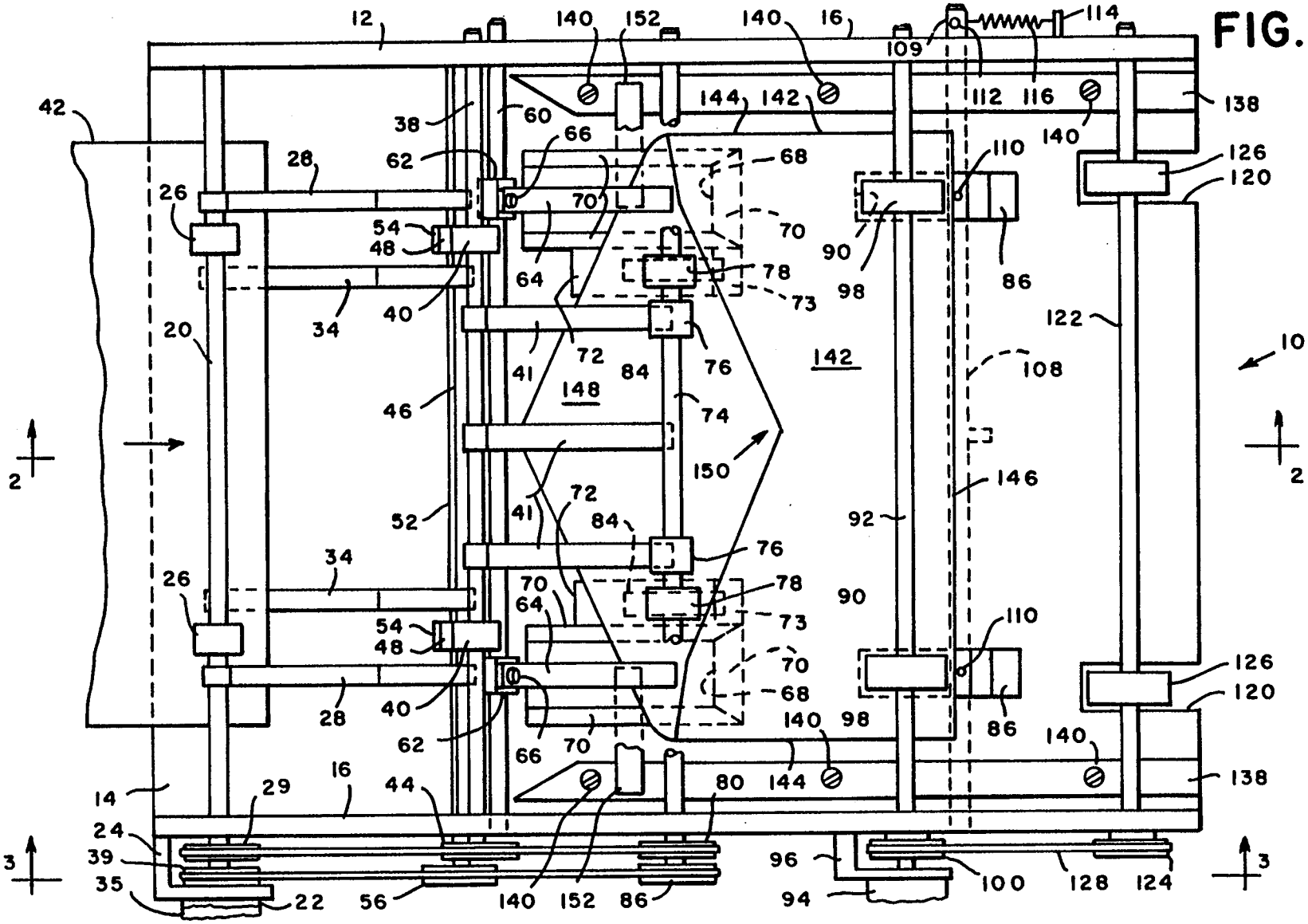
FIG. 1 is a plan view of an envelope stuffing device that practices the instant invention.

With reference to the drawing, an envelope stuffing device is shown generally at 10 and has a housing 12 that is composed of a floor 14 to which a pair of side walls 16 are attached as by screws 18. A drive shaft 20 is rotatably supported within the side walls 16 with one end of the shaft extending through one of the side walls. The shaft 20 is connected at its exterior portion to a motor 22 that is supported on the housing 12 by an L shaped bracket 24. The drive shaft 20 has a pair of drive rollers 26 mounted thereon and supports one end of a pair of upper guide fingers 28. Attached to the exterior portion of the drive shaft 20 intermediate one of the side walls 16 and the bracket 24 is a pulley 29.

Another shaft 30 is rotatably supported by the side walls 16 and is located below and parallel with the drive shaft 20. The shaft 30 has a pair of idler rollers 32 mounted thereon, the idler rollers being in contact with the drive rollers 26 to be driven thereby. The shaft 30 supports one side of a pair of lower guide fingers 34. Located below the first motor 22, and supported by the L shaped bracket 24, is a second motor 35 which is attached to a shaft 36 that is rotatably supported by the side walls 16. This shaft 36 is located below and parallel with the shaft 30 and has a pair of drive rollers 37 mounted thereon that are in contact with the floor 14 of the housing 12. All rollers in the instant disclosure are made of a resilient material such as soft foam material. In the reduction to practice, the rollers of the stuffing drive 10 were made of polyurethene.

Figure 2:
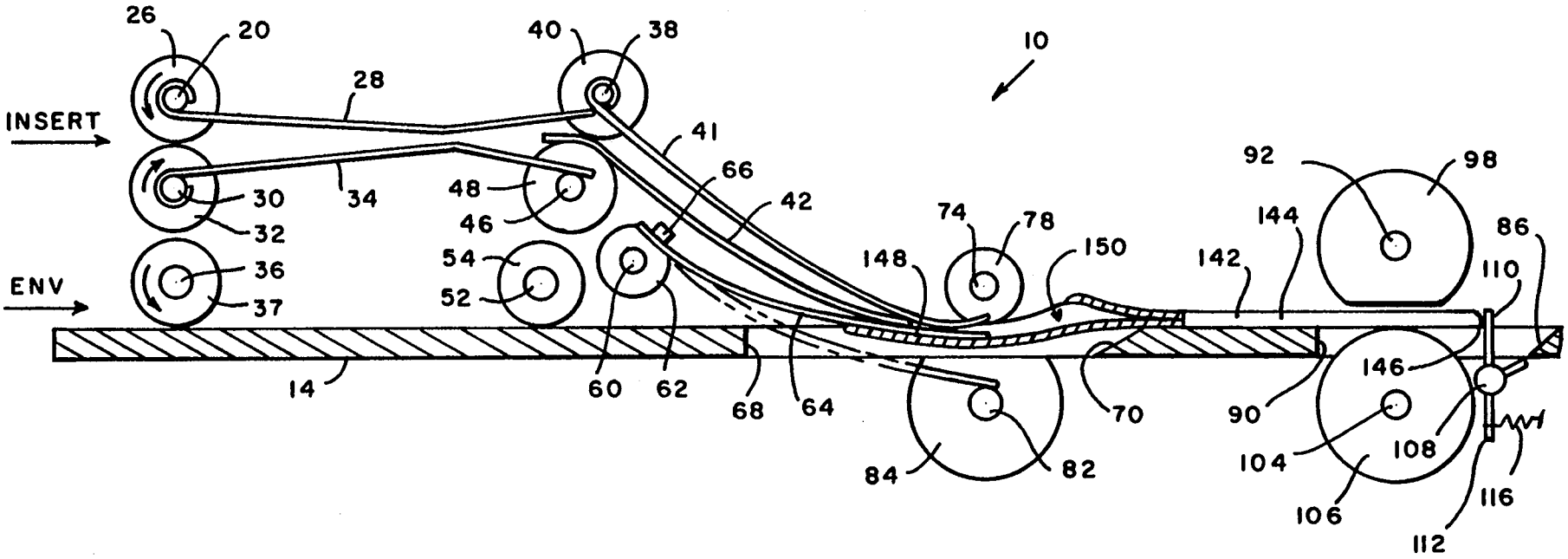
FIG. 2 is a longitudinal view of the device shown in FIG. 1, taken along the lines 2—2 of FIG. 1.
Figure 3:
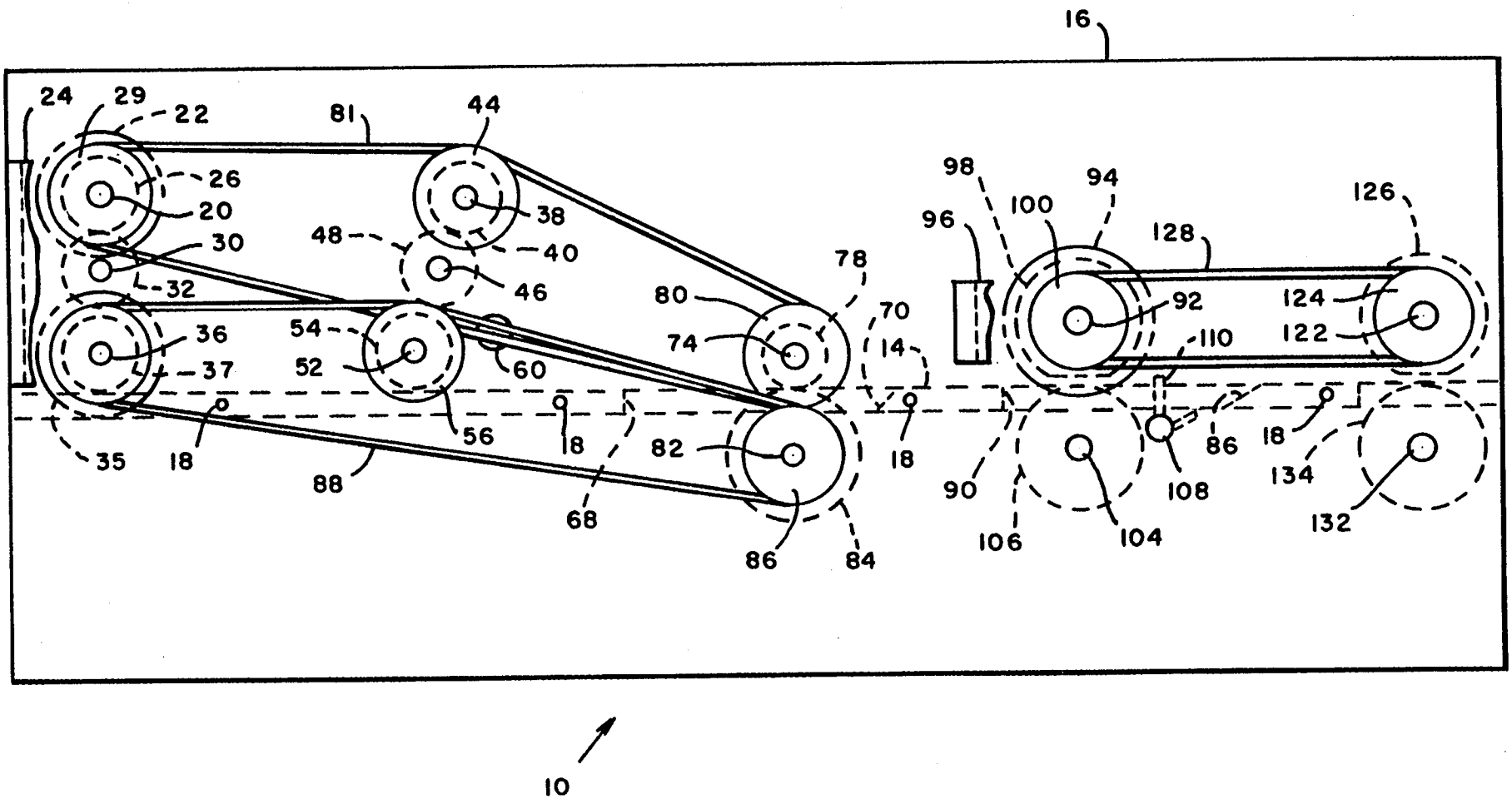
FIG. 3 is also a longitudinal view of the envelope stuffing device taking along the lines 3—3 of FIG. 1.

A shaft 38 is rotatably supported by the side walls 16 and has a pair of rollers 40 mounted thereon. The shaft 38 supports the other end of the upper guide fingers 28 and also has a plurality of leaf springs 41 extending therefrom, which leaf springs engage the floor 14 of the housing at their non-supported ends. The shaft 38 has a portion that extends through a side wall 16, and this exterior shaft portion supports a pulley 44 located outside the housing 12. Located below the shaft 38 is another shaft 46 that is rotatably supported by the side walls 16. The shaft 38 has a pair of idler rollers 48 in contact with the rollers 40 to be driven thereby. The shaft 46 supports the downstream end of the lower guide fingers 34. An insert 42 is shown held between the nip of the rollers 26, 32 as seen in FIG. 1 and located below the leaf springs 41 as seen in FIG. 2, the insert being conveyed from left to right in both FIGS. 1 and 2 as indicated by the arrows. Although rollers are used in the preferred embodiment to convey the inserts and envelopes, it will be appreciated other mechanisms, such as belts can also be used. With regard to the inserts, they can be cut sheets, folded or stapled sheets, return envelopes and the like.

A shaft 52 is located below and parallel with the shaft 46 and is rotatably supported by the side walls 16. A portion of the shaft 52 extends through one of the side walls 16 and has mounted thereon a pulley 56 on that portion outside the housing 12. A pair of rollers 54, are mounted on the shaft 52 intermediate the side walls 16 and contact the floor 14. Located downstream from the shaft 52 is another shaft 60 that is fixedly mounted by the side walls 16 and which has a pair of collars 62 attached thereto. A pair of leaf springs 64 are attached to the collars 62 as by bolts 66. The floor 14 has a pair of beveled openings 68, each of which has three declining surfaces 70. The leaf springs 64 are receivable within the openings 68. A second pair of openings 72 having only one chamfered surface 73 are located adjacent to the first pair of openings 68 and located laterally inwardly therefrom.

A shaft 74 is rotatably supported between the side walls 16 and has a portion that extends through one of the side walls with a pulley 80 mounted thereon. A belt 81 is trained about the pulleys 29, 44, 80 thereby providing drive to the shafts 38, 74. A pair of rollers 78 is mounted on the shaft 74, each roller being received within one of the openings 72. Another shaft 82 is rotatably supported by the side walls 16 and has a portion that extends beyond one side wall to support a pulley 86. The shaft supports a pair of rollers 84 that are received within the openings 72 and are in registration with the rollers 78.

A stepper motor 94 is supported by an L shaped bracket 96 and is connected to a shaft 92 to provide rotation thereof. The shaft 92 is rotatably supported by the side walls 16 and supports a pair of D-rollers 98 that are receivable within laterally spaced openings 90 of the floor 14. Mounted on the shaft 92 intermediate the housing 12 and the bracket 96 is a pulley 100. Another shaft 104 is located below and parallel with the shaft 92 and has a pair of idler rollers 106 that are received within the opening 90 and are in engagement with non-truncated portion of the the rollers 98 to be driven thereby. Another shaft 108 is rotatably supported by the side walls 16 and has a portion 109 that extends beyond one of the side walls. The shaft 108 has a pair of projections 110 each extending vertically upwardly into one of the openings 90 when the shaft 108 is in its rest position. Another projection 112 depends from the shaft portion 109. A pin 114 is mounted on one of the side walls 16 and a compression spring 116 has one end attached to the projection 112 and its other end attached to the pin 114 so as to urge the shaft 108 in a counterclockwise direction as seen in FIG. 2.

A pair of slots 120 are located at the downstream end of the floor 14 and a shaft 122 is rotatably supported by the side walls 16. The shaft 122 has a portion extending through one of the side walls 16 which portion has mounted thereon a pulley 124. The shaft 122 has a pair of rollers 126, each of which is received within a slot 120. A belt 128 is trained about the pulleys 100, 124 for the purpose of providing drive to the shaft 122. Another shaft 132 is located below and parallel to the shaft 122, the former shaft 132 having idler rollers 134 that are in registration and in contact with the rollers 126 to be driven thereby.

Attached to the floor 14 are a pair of optional, spaced guide members 138 that are secured to the floor as by screws 140. An envelope 142 is shown disposed on the floor 14 intermediate the guide members 138 with the lateral sides 144 of the envelope being oriented in the direction of travel of the envelope and the longitudinal side of the envelope 146 being disposed in a lateral direction relative to the housing 12. The flap 148 of the envelope 142 is in a trailing position and the mouth of the envelope is shown generally at 150. A beam 152 is connected to each of the guide members 138 to extend laterally inwardly. The beams 152 serve the functions of guiding the insert 42 between the beams and the floor 14 and, in conjunction with the leaf springs, to cause the insert 42 to bend to form a curve thereby providing stiffness to the insert rendering it easier to insert.

In an operation, the motors 22, 35, and 94 will be enabled so as to rotate all the rollers shown in FIG. 2 and an insert 42 will be fed to the nip of the rollers 20, 32 while an envelope is fed beneath the roller 37 to be conveyed thereby along the floor 14. It will be appreciate that the speed of the motor 35 and the speed of the motor 22 will not necessarily be the same as the envelope 142 will have a greater longitudinal (relative to the housing 12) length then will the insert 42. At any rate, the rotational speed of the rollers will be synchronized to accomplish the operation to be described. An insert 42 will be placed at the nip of and driven by the rollers 26, 32 to be conveyed between the guide fingers 28, 34 to the nip of the rollers 40, 48 where it will be urged downwardly by the leaf springs 41.

In the meantime, an envelope 142 will be placed upon and driven across the floor 14 by the rollers 37 onto the roller 54 to be driven longitudinally onwardly, in the direction indicated by the arrows, until it is contacted by the leaf springs 41, 64. Upon such contacting, central portion of the envelope will be held against the floor 14 by the leaf springs 41 while the end portions of the envelope will be urged downwardly into the openings 68. The leaf springs 64 contact the envelope but tend to be urged into the openings 68 with only the envelope preventing such coil springs from falling into such opening. This places a force on the envelope 142 which causes the ends of the envelope to be pressed downwardly. In the reduction to practice, the leaf springs were approximately ⅜" wide with closest side of a leaf spring 64 approximately 1 3/16" from the edge of an envelope. It will be appreciated these dimensions will vary depending upon the size of the envelope 142, business size envelopes being used in the reduction to practice.

In the meantime, the flap 148 trails the balance of the moving envelope 142. The leaf springs 41, 64 will eventually contact the flap. With the leaf springs 41 contacting the central portion of the flap and the leaf springs 64 during the end portions into the openings 68, this causes the mouth 150 to pucker or open, when the leaf springs 64 engage the flap portion of the envelope. As the mouth 150 is being opened, the movement of the insert 42 is controlled so as to be driven by the rollers 48 below the coil springs 41 and into the open mouth 150 of the envelope 142. At this point, when the insert is traveling into than the envelope 142, the D-rollers 98 are in a position whereby they lose contact with the envelope 142 and the projections 110 of the shaft 108 contact the envelope with a biasing force generated by the compression spring 116. At this point, the stepper motor 22, 94 is disabled, the envelope is at rest and the required number of inserts are inserted. It will be appreciated that the drive of the rollers 78 alone are not sufficient to convey an envelope. Once insertion is complete, the rollers 86, 98, 106 will be rotated, causing roller 98 to once more contact the envelope, and drive the envelope past the projections 110 by overcoming the biasing force of the spring 116 and remove the stuffed envelope from the floor 14 in cooperation with the drive from the rollers 124, 134.

It will be observed that there are no moving parts that are required to open the mouth 150 of the envelope 144. Such opening is caused by the force of the springs 64 acting on the end portions of the envelope flap 148 to apply a force that causes the mouth 150 of the envelope to open. This is because the leaf spring 64 are pushing the ends of the flap 148 downwardly while the leaf springs 41 are acting on the central portion of the flap to hold the same firmly upon the floor 14. Although mechanism may be included to rotate the shaft 60 to vary the biasing force of the springs 64, this is an option which was not found to be necessary.

The above embodiment has been given by way of illustration only, and other embodiments of the instant invention will be apparent to those skilled in the art from a consideration of the above description and limitations on the instant invention are to be found only in the claims.

What is claimed is:

1. An envelope stuffing device, comprising:

a house having a longitudinally extending floor, said floor having a pair of laterally spaced openings therein;

means for conveying an envelope with a trailing open flap over said laterally spaced openings of said floor;

means for conveying an insert above said floor;

a pair of springs that engage the flap of an envelope;

means for fixedly supporting said pair of springs above to said floor with one of said springs received within each of said laterally spaced floor openings for forcing the flap to deflect downward into the openings to open the envelope; and means for conveying an insert toward an envelope located on said floor and into said envelope when said pair of springs are engaged with the flap of an envelope.

2. The envelope stuffing device of claim 1 wherein each of said openings is located adjacent a longitudinal side of said floor.

3. The stuffing envelope of claim 1 further including means supported by said housing intermediate said pair of springs for holding the central portion of an envelope against said floor.

4. The envelope stuffing device of claim 3 further including means supported by said housing for curving an insert prior to the insert engaging an envelope.

5. The envelope stuffing device of claim 3 further including means for rendering an envelope static while an insert is being placed therein.

6. The envelope stuffing device of claim 3 further including means for guiding an envelope longitudinally across said floor.

7. The envelope stuffing device of claim 6 wherein said guide means supports means for causing an insert to form a curve prior to being fed into an envelope.

8. The envelope stuffing device of claim 3 wherein said envelope conveying means conveys an envelope with its flap trailing.

9. An envelope stuffing device for stuffing inserts into envelopes, comprising:

a longitudinally extending housing having a pair of side walls and a horizontal floor supported between said pair of walls defining an upstream end and a downstream end, said floor having a pair of longitudinally extending, laterally spaced openings therein;

a first shaft rotatably supported by said side walls at an upstream location relative to said spaced openings and having a pair of first drive rollers thereon;

means for rotating said first shaft;

a second shaft rotatably supported by said side walls and having a first pair of idler rollers in engagement with said pair of first drive rollers, said first drive rollers and said first idler rollers being operative to drive an insert;

a third shaft rotatably supported by said side walls and having a second pair of drive rollers mounted thereon and in engagement with said floor, said second pair of drive rollers being operative to convey an envelope over said floor;

means for rotating said third shaft;

a fourth shaft rotatably supported by said side walls and having a third pair of drive rollers mounted thereon;

means for rotating said fourth shaft;

a fifth shaft rotatably supported by said side walls and having a second pair of idler rollers in engagement with said third pair of drive rollers mounted on said fourth shaft;

a sixth shaft rotatably supported by said side walls and having a fourth pair of spaced apart drive rollers in engagement with said floor;

means for rotating said sixth shaft;

a seventh shaft supported by said side walls above said floor, and having a pair of collars mounted thereon, said first through seventh shafts being located upstream from said openings;

a leaf spring mounted on each collar with one end of each spring receivable within one of said openings, so as to contact an envelope conveyed over said floor by deforming the flap of the envelope into the openings to cause the envelope to open;

guide means extending from said forth shaft toward said longitudinally extending spaced openings;

whereby upon said springs opening the mouth of an envelope, said guide means guides an insert driven by said first and third driver rollers into the envelope;

an eighth shaft supported by said side walls downstream from said fifth shaft and having a fifth pair of laterally spaced drive rollers mounted thereon which are received within said openings; and means for rotating said eighth shaft to convey an envelope across said floor.

10. The envelope stuffing device of claim 9 further including at least one leaf spring supported by said fourth shaft intermediate said pair of leaf springs, said at least one leaf spring being in engagement with said floor to convey an insert toward the floor and secure a portion of an envelope against said floor when positioned between said at least one leaf spring and said floor.

11. The envelope stuffing device of claim 10 further including a pair of laterally extending beams supported by said housing above said floor and in lateral alignment with said at least one leaf spring whereby said at least one leaf spring directs a insert driven by said rollers on said fourth and fifth shafts between said beams and said floor to cause the insert to form a curve.

12. The envelope stuffing device of claim 10 further including a second pair of laterally space openings in said floor longitudinally spaced from said first pair of openings, a ninth shaft supported by the housing and having a pair of rollers received within said second pair of openings, said second pair of rollers of said ninth shaft being in engagement with the rollers of said eighth shaft, and means for rotatably driving said ninth shaft.

13. The envelope stuffing machine of claim 12, further including a tenth shaft rotatably supported by said housing and having a pair of projects in lateral alignment with said second pair of openings and means acting of said shaft for urging said pair of projections into said second pair of openings.

14. A method of stuffing inserts into an envelope that has four sides, the steps comprising:

conveying an envelope with a trailing flap over a longitudinal floor having laterally spaced openings;

conveying an insert above the floor;

applying pressure at the location of the openings upon the envelope adjacent to the envelope sides that are located laterally relative to the longitudinal floor forcing the flap of the envelope to deflect into the openings causing the throat of the envelope to open; and directing an insert into the envelope as the pressure is applied to the laterally located sides of the envelope.

15. The method of claim 14 wherein the envelope is conveyed across a longitudinally extending floor having openings located adjacent a longitudinal side of the floor, the pressure applied to the envelope is created by engaging the envelope springs.

16. The method of claim 14 further including the step of keeping the envelope static as an insert is being inserted therein.

* * * * *